United States Patent [19]

Sato

[11] Patent Number: 4,981,833

[45] Date of Patent: Jan. 1, 1991

[54] RECORDING MATERIAL USING THERMODECOLORING DYE

[75] Inventor: Kozo Sato, Kanagawa, Japan

[73] Assignee: Fuji Photo Film Co., Ltd., Kanagawa, Japan

[21] Appl. No.: 452,650

[22] Filed: Dec. 19, 1989

[30] Foreign Application Priority Data

Dec. 19, 1988 [JP] Japan ..... 63-320164

[51] Int. Cl.[5] ..... B41M 5/18

[52] U.S. Cl. ..... 503/202; 428/195; 428/913; 428/914; 503/218; 503/220; 503/221; 503/223; 503/224

[58] Field of Search ..... 428/195, 913, 914; 503/202, 218, 220, 221, 223, 224

[56] References Cited

U.S. PATENT DOCUMENTS 4,894,358 1/1990 Filosa et al. ..... 503/201

FOREIGN PATENT DOCUMENTS 2225392 10/1987 Japan ..... 503/202

*Primary Examiner*—Bruce H. Hess

*Attorney, Agent, or Firm*—Sughrue, Mion, Zinn, Macpeak & Seas

[57] ABSTRACT

A recording material comprising at least one thermodecoloring type dye represented by formula (I) or formula (II)

(I)

(II)

wherein $Ar^1$ and $AR^2$ each represents an aryl group or heteroaryl group; $R^1$ represents an alkyl group, alkenyl group, aralkyl group, aryl group, or heteroaryl group; A represents an atomic group forming a 5 to 6 member ring; and $X\ominus$ represents a residue with an electric charge value of -1; or $Ar^1$ and $Ar^2$ bond together to form a ring.

9 Claims, No Drawings

RECORDING MATERIAL USING THERMODECOLORING DYE

FIELD OF THE INVENT

The present invention relates to heat sensitive recording materials. More particularly, the invention relates to heat sensitive recording material containing dyes which are decolored by heating.

BACKGROUND OF THE INVENTION

A variety of systems are known in color recording technology. For example, systems such as electrophotographic systems, ink jet systems and heat sensitive transfer systems are already in practical use. Of these, the heat sensitive transfer system is in wide use since it is considered more advantageous than the other systems because the maintenance and operation of related equipment are easy and this equipment and the associated consumables are economical. However, a heat sensitive transfer system involves the setting in position of two sheets, an ink sheet and a transferred sheet, and therefore necessitates a variety of adjustments relating to material and equipment if high image quality is to be achieved. In particular, forming multicolor images involves successive transfer of a plurality of ink sheets and in this case therefore it is essential to take especial care to avoid color fringing. Consequently, there have been calls for non-transfer type color heat sensitive recording materials permitting direct thermal recording using just a single sheet of recording paper.

Thermal color development material as typified by heat sensitive paper is known as non-transfer type heat sensitive recording materials. However, although there have been attempts to make such a material into a multicolor recording material, no full-color heat sensitive recording material is known as yet.

To produce full-color heat sensitive recording materials, it is preferable to use materials with the characteristic that compounds per se go irreversibly from being colorless to being colored on heating, or conversely go from being colored to being colorless on heating. The compounds disclosed in the specification of WO No. 86-07,312 are known as the former type of compounds which change from being colorless to being colored on heating, but the disclosed compounds have the drawback that the changes in hue are slow and that quite a high temperature is needed. Compounds which are decolored through the action of alkalis are known as the latter type of compounds which are changed from being colored to being colorless, from, e.g., U.S. Pat. No. 4,258,118, but no examples of compounds which are changed to colorless simply through heating alone have been reported.

It is the object of the present invention to provide dyes which change rapidly from being colored to being colorless on heating. The invention also has as its object to provide a heat sensitive recording material comprising such dyes.

SUMMARY OF THE INVENTION

These objects of the invention are achieved by a recording material comprising at least one thermodecoloring dye represented by formula (I) or formula (II)

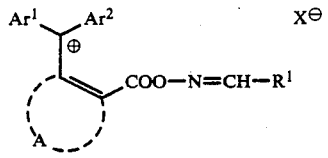

(I)

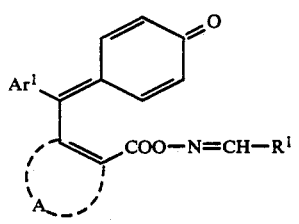

(II)

wherein $Ar^1$ and $Ar^2$ each represents heteroaryl group; $R^1$ represents an alkyl group, alkenyl group, aralkyl group, aryl group, or heteroaryl group; A represents an atomic group forming a 5 or 6 member ring; and $X^{63}$ represents a residue with an electric charge value of $-1$; or $Ar^1$ and $Ar^2$ bond together to form a ring.

$Ar^1$, $Ar^2$, $R^1$ and the rings A in formula (I) and (II) and the

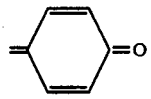

ring in formula (II), may be substituted by substituents.

DETAILED DESCRIPTION OF THE INVENTION

Formulae (I) and (II) are now described in further detail.

$Ar^1$ and $Ar^2$ each represents an aryl or heteroaryl group, preferably a group with an electron donor group(s) (e.g., dialkylamino, alkoxy) in the ortho or para position. Particulary preferred groups include p-dialkylaminophenyl, o-alkoxy-p-dialkylaminophenyl and 1,2-dialkyl-3-indolyl groups, and one may also suitably make use of components in which $Ar^1$ and $Ar^2$ form a xanthene group with the assistance of oxygen atom.

$R^1$ represents an alkyl, alkenyl, aralkyl, aryl or heteroaryl group, and within these aryl and heteroaryl groups are preferred. Particulary preferred groups include p-dialkylaminophenyl, o-alkoxy-p-dialkylaminophenyl, 2,4,6-trialkoxyphenyl, 2,4,6-trialkylphenyl, 1-naphthyl, 2-alkoxy-1-naphthyl, 2,4-dialkoxy-1-naphthyl and 1,2-dialkyl-3-inodolyl groups.

A represents an atomic group forming a 5 or 6 member ring. Specific examples include benzene, naphthalene, indole, benzofuran, benzothiophene, pyridine, pyrazine and quinoxaline rings, and within these benzene and pyridine rings are particularly preferred.

$X^{63}$ represents a monovalent anionic group, with preferred examples including $Cl^-$, $Br^-$, $I^-$, $BF_4^-$, $ZnCL_3^-$, $ClO_4^-$, $PF_6^-$, $HSO_4^-$, $TsO^-$ and $CF_3SO_3^-$.

Conventional substituents can be used as substituents for the

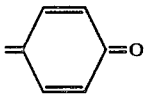

ring of formula (II), and substituents are selected in accordance with the hue of the dye concerned. Examples include halogen atoms and hydroxyl, cyano, carboxyl, sulfo, alkyl, cycloalkyl, aralkyl, aryl, heterocyclic, alkoxy, aryloxy, amino, acylamino, sulfonylamino, acyl, sulfonyl, carbamoyl, sulfamoyl, ureido, urethane, alkylthio, arylthio, nitro and alkolxycarbonyl groups. Two or more substituents may be present, and in this case the substituents may be the same or different. Also, two or more substituents may be mutually bonded to form a ring. By way of preferred examples of this, one may cite rings that have been made benzologs.

Similar substituents to those above may be cited as ring A substituents.

Specific examples of the thermodecoloring dyes used in accordance with the invention are set forth below, although the invention is not limited to these examples.

(1)

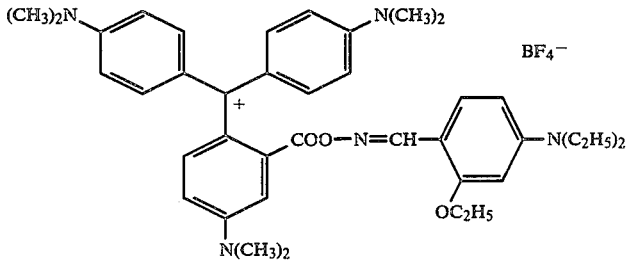

(2)

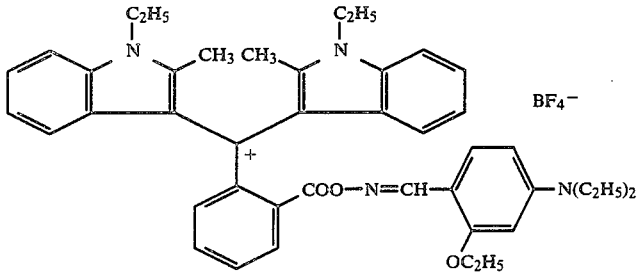

(3)

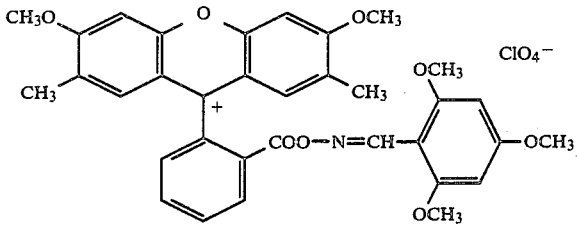

(4)

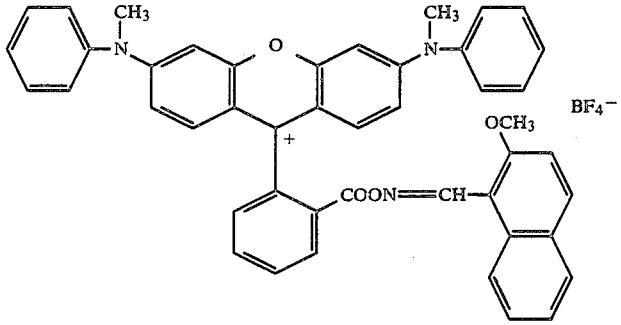

-continued
(5)
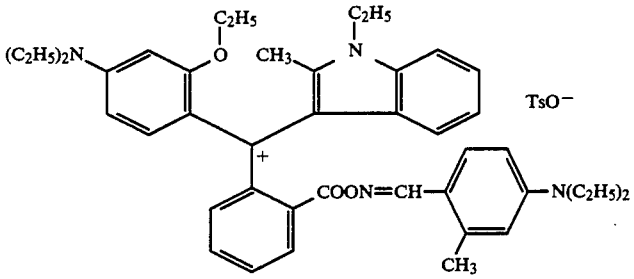
(6)
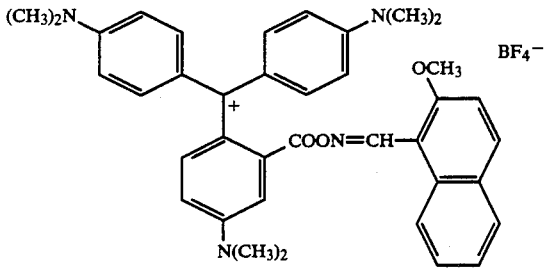
(7)
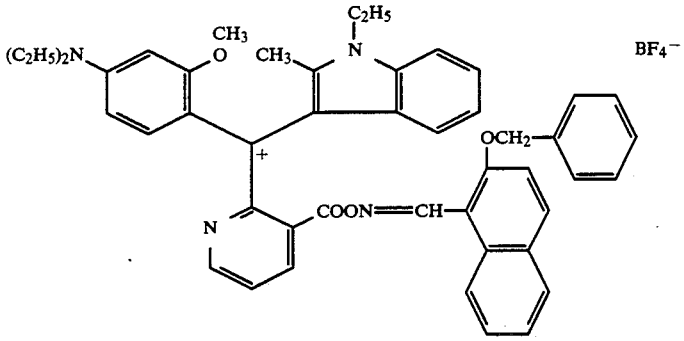
(8)
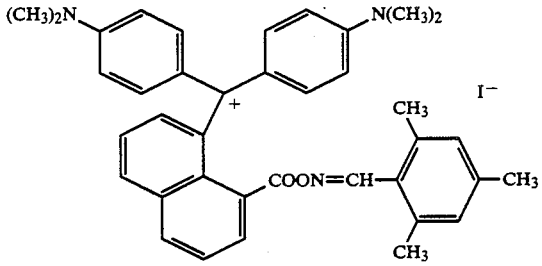
(9)
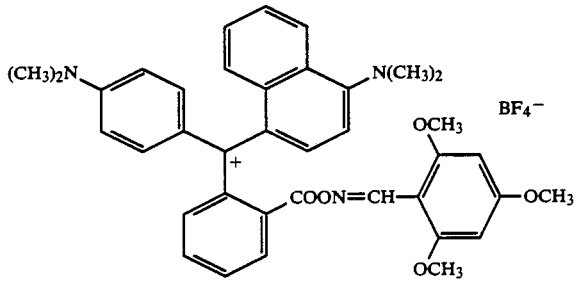

-continued
(10)
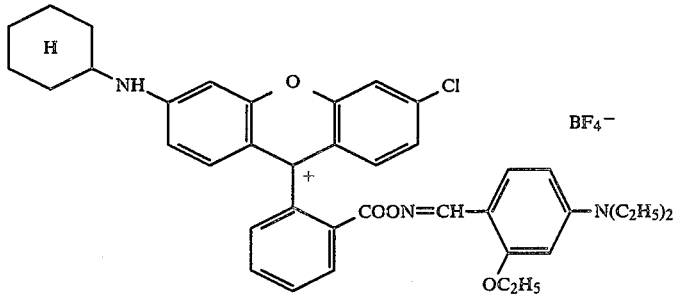
(11)
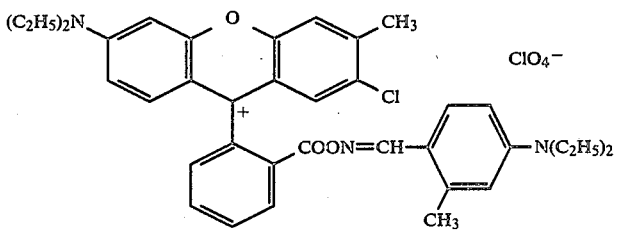
(12)
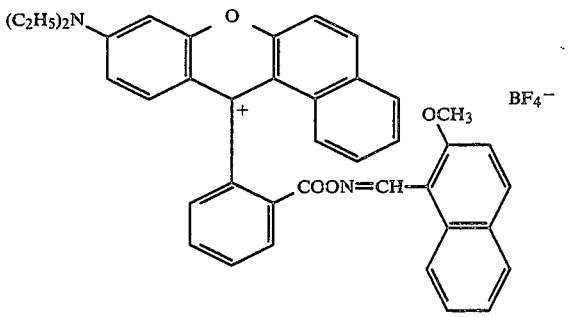
(13)
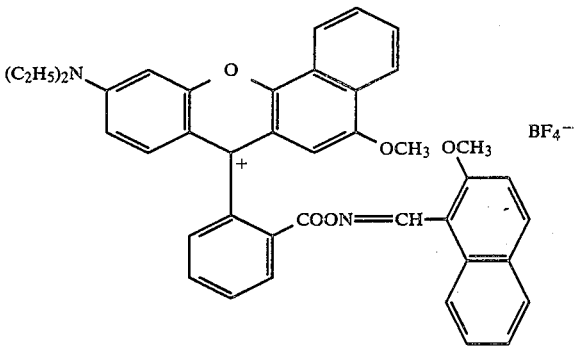
(14)
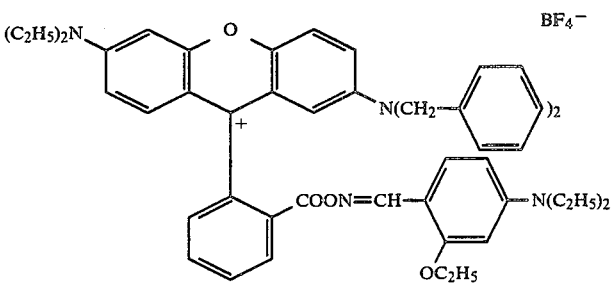

-continued
(15)
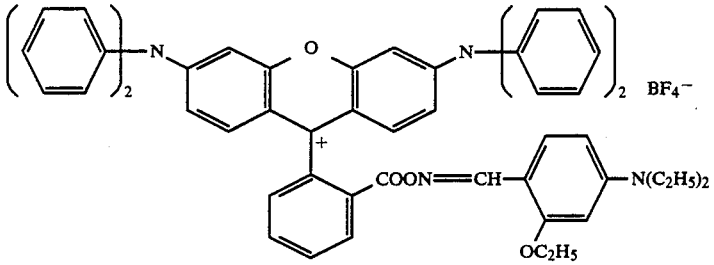
(16)
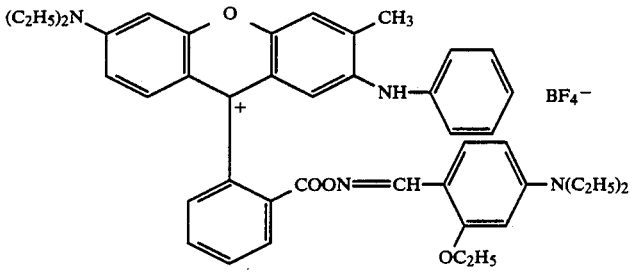
(17)
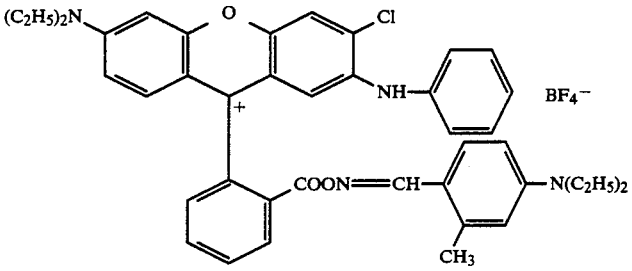
(18)
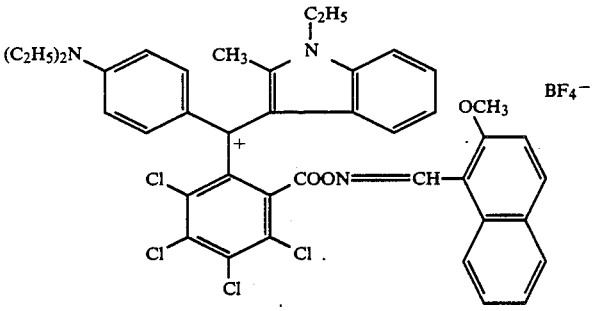
(19)
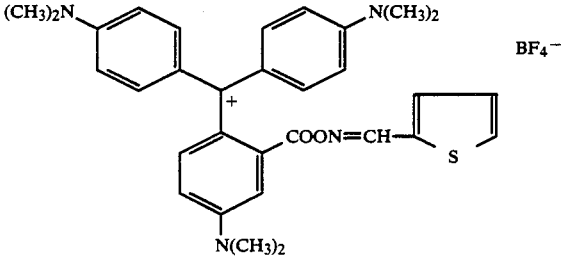

-continued
(20)
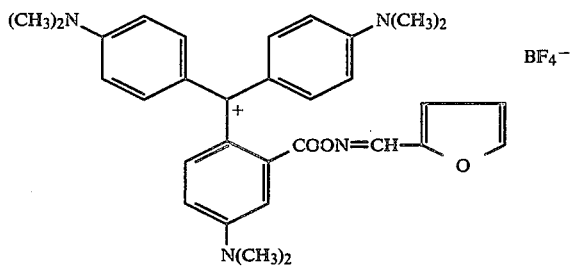
(21)
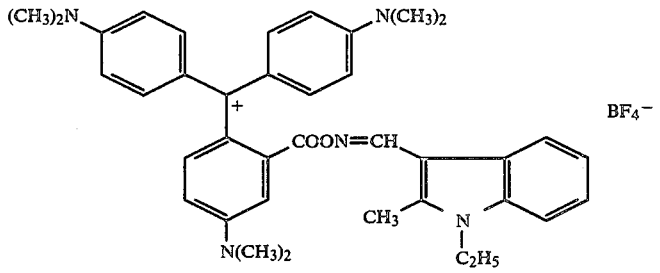
(22)
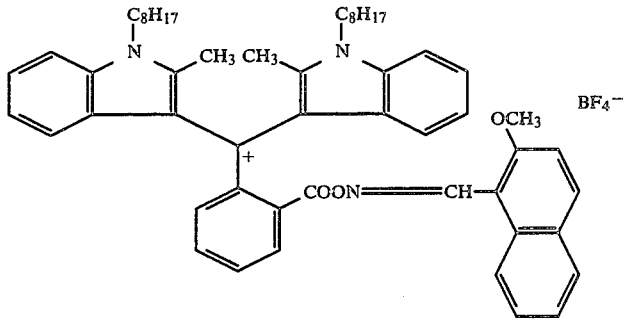
(23)
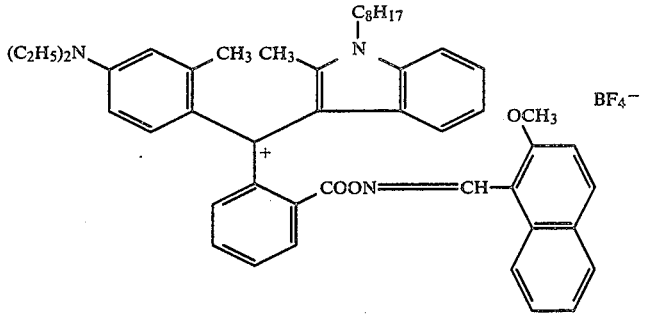
(24)
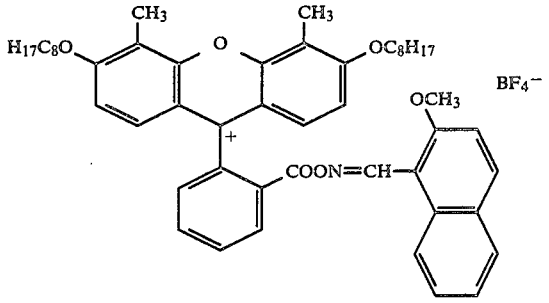

-continued
(25)
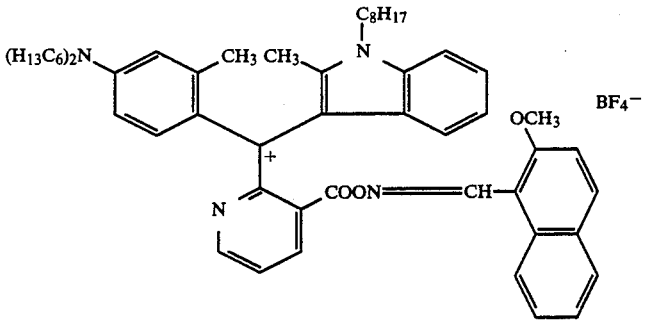
(26)
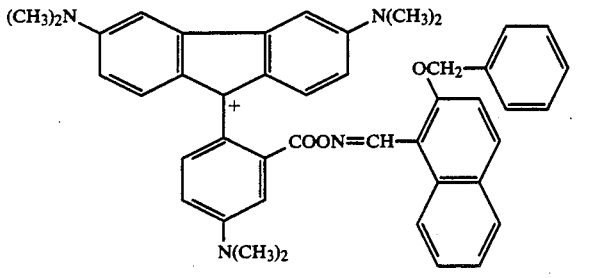
(27)
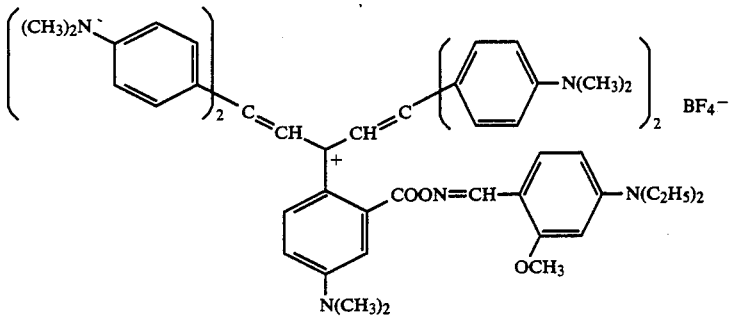
(28)
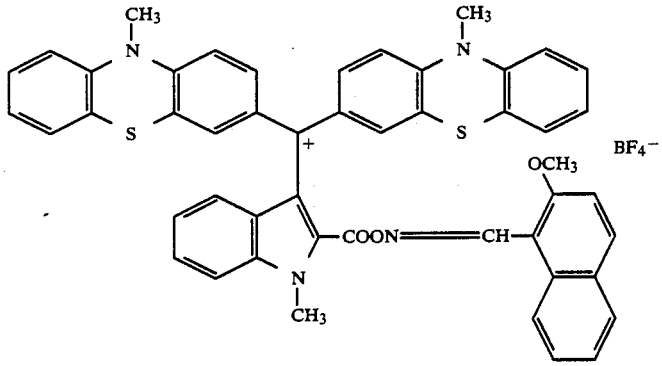
(29)
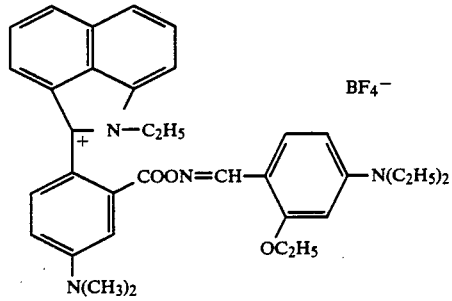

-continued
(30)
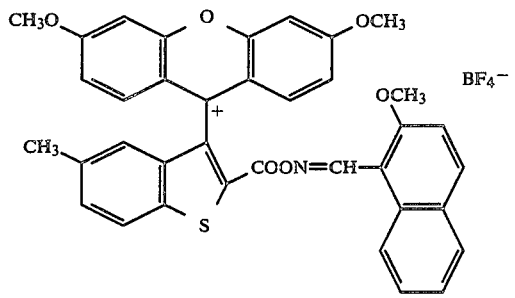
(31)
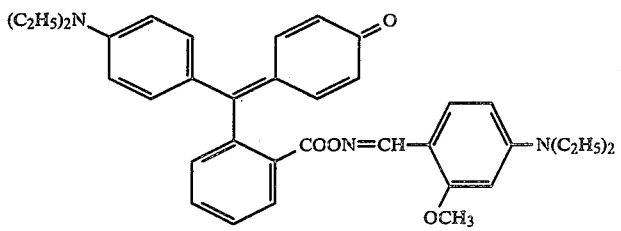
(32)
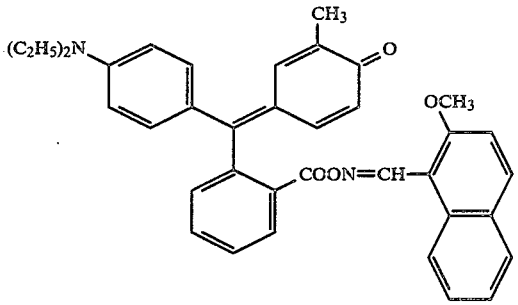
(33)
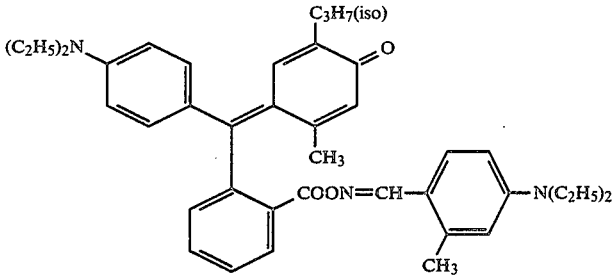
(34)
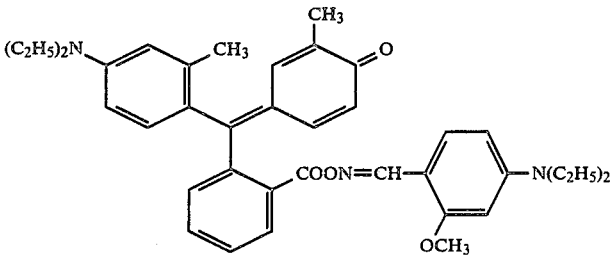

-continued
(35)
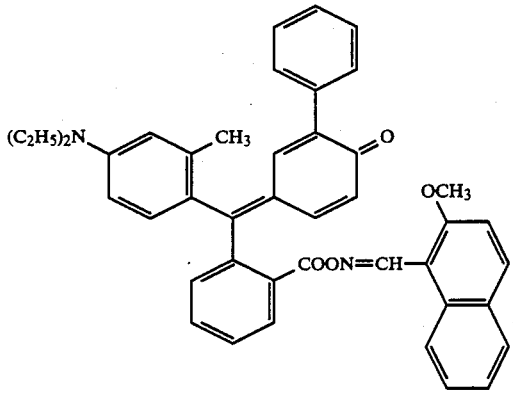
(36)
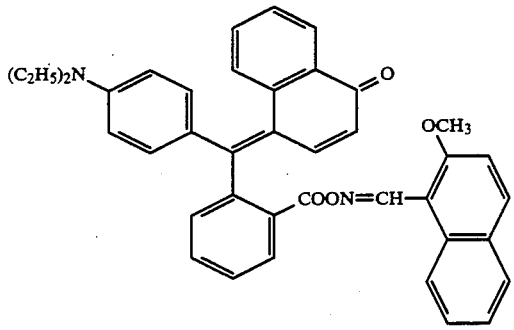
(37)
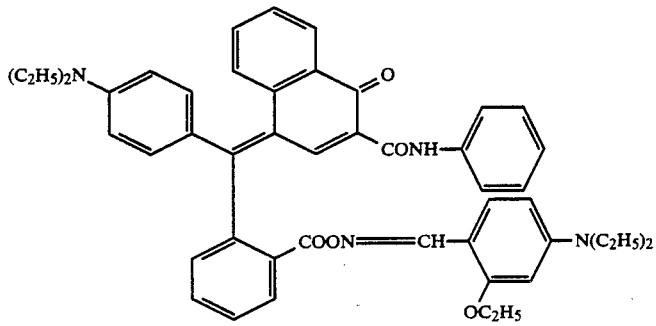
(38)
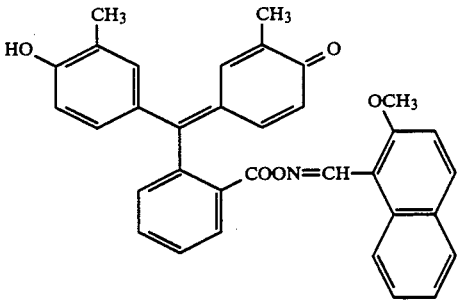
(39)
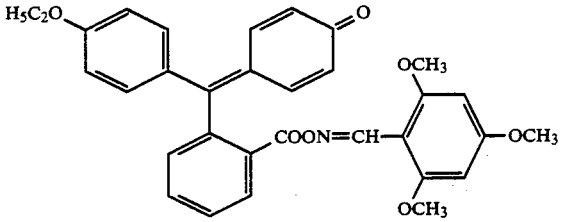

-continued (40)

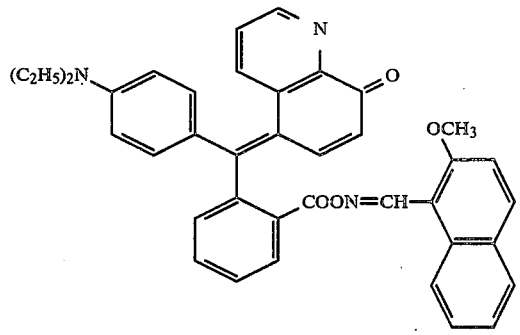

(41)

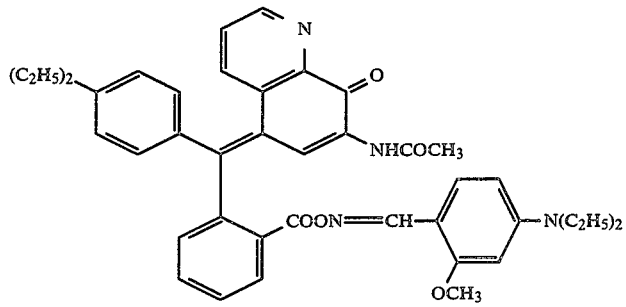

(42)

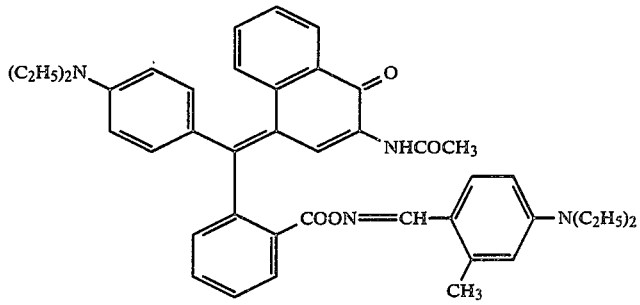

Methods of synthesizing such thermodecoloring dyes are described below.

There are a number of methods of synthesizing the thermodecoloring dyes of the invention, but the most general method is one as shown in the following scheme, in which a dye carboxylic acid and an aldoxime are condensed.

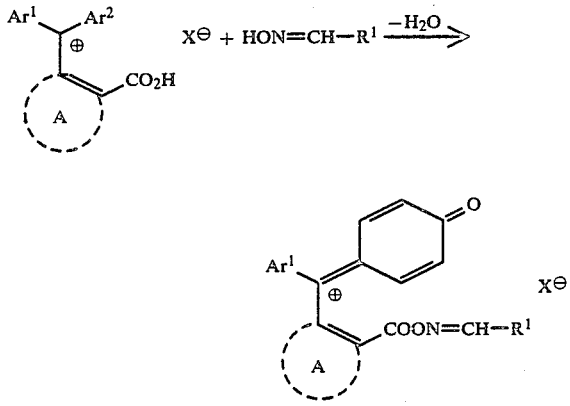

It is usually advantageous for carboxylic acid and aldoxime condensation reactions that the carboxylic acids are activated by conversion to acid chlorides, active esters or mixed anhydrides, etc., and then reacted with aldoximes in the presence of a base. There now follows a description of specific examples of synthesis of the thermodecoloring dyes in accordance with the invention.

Synthesis of compound (6)

a. 2 Methoxy-1-naphthoaldoxime:

80 9 of 2-methoxy-1-naphthoaldehyde, 66 g of sodium acetate and 35.5 g of hydroxylamine hydrochloride were added to 400 ml of ethanol and 180 ml of water and heated at reflux for 2 hours. The reaction solution was poured into 1 l of water and left to cool to room temperature over a period of 3 hours and then the crystals were removed by filtering, so giving 85 g of 2-methoxy-1-naphthoaldoxime.

b. 2-Methoxy-1-napthoaldoxime sodium salt:

7.1 g of 2-methoxy-1-naphthoaldoxime was added to 300 ml of dry acetonitrile and then 1.7 g of 50% oily sodium hydride was gradually added and the material was stirred for 30 minutes at room temperature until production of hydrogen stopped.

c. Compound (6):

12.6 g of 3,3-bis(4-dimethylaminophenyl)-6-dimethylaminophthalide was added to 100 ml of dry methylene chloride and then 4.45 g of oxalyl chloride was added dropwise at 0° to −5° C. After being stirred for 1 hour at 0° C., the material was added, at 0° to 5° C., to the above noted 2-methoxy-1-naphthoaldoxime sodium salt solution and stirred for 1 hour at room temperature.

After concentration of the solvent under reduced pressure, 10 ml of ethanol and 20 ml of a 40% aqueous solution of tetrafluoroboric acid were added and the resulting compound (6) in the form of a blue precipitate was removed by filtering and washed with a small amount of water and diethyl ether. The yield was 4.5 g and the decomposition point was over 250° C.

Other compounds exemplified above can also be synthesized in a similar way.

The thermodecoloring dyes of the invention can be used for a variety of color recording materials. For example, dyes of the invention can be coated uniformly and dried on a reflective support such as paper, or on a transparent support, and after this a color image can be produced very easily by thermal printing with any desired thermal stamp. Other heating methods that may be employed include printing with the thermal head of a heat sensitive printer, imagewise irradiation with laser light and irradiation with infrared rays after superimposition of a black-and-white photomask.

There are also a number of ways of effecting multicolor recording. For example, one can employ a method in which use is made of a plurality of dyes of the invention that decolor at different temperatures, and making several thermal printings at different temperatures for each thermal printing; a method in which dyes of this invention are used in combination with infrared absorbing dyes to prepare a plurality of combinations with varying absorption wavelengths in the infrared ray absorption dyes, these are coated on a support in the form of a dot matrix or stripes, and several scanning imagewise exposures are effected using laser light with wavelengths matching the absorption wavelengths of the respective infrared ray absorption dyes; or a method in which combinations of dyes of the invention and infrared ray absorbing dyes are coated in a multilayer configuration on a support and then several scanning exposures are effected with the depths of laser light focal points made to match the depths of the various layers. The infrared ray absorbing dyes employed in such cases comprise a variety of known substances, examples including cyanine dyes; squarenium dyes; thiol nickel complexes; phthalocyanine dyes; triarylmethane dyes; immonium and diimmonium dyes; naphthoquinone and anthraquinone dyes; indoaniline dyes and nitroso metal complexes. Characteristics demanded of the infrared ray absorbing dyes include sharp absorption peaks and large molecular extinction coefficients, extremely small absorption in the visible region and only slight apparent coloration. Compounds of the invention such as compounds (26), (27) and (28) are themselves compounds which absorb infrared light, and since also they become colorless on being heated, joint use thereof with other compounds of the invention is extremely advantageous. If use is made of a plurality of combinations of thermodecoloring dyes and infrared ray absorbing dyes of the invention, these various dyes can be encapsulated in microcapsules to serve as microcapsules which are sensitive to different colors.

The amount used of the thermodecoloring dyes of the invention varies depending on the type and intended purpose of the recording material and also on the physical properties of the compounds themselves, but generally the amount is in the range of from 0.1 to 3.0 g/m$^2$.

The thermodecoloring dyes of the invention can be added to a recording material by a variety of methods. For example, they can be dissolved in a water-miscible solvent such as an alcohol, acetone or dimethylformamide, or in a mixed solution of such a solvent and water and coated on a support. A useful procedure for strongly hydrophobic compounds is to add them after they have been emulsified and dispersed while dissolved in a nonvolatile oil. A useful procedure for water-insoluble dyes is to add them as a dispersion of solids in the form of micrograins. The thermodecoloring dyes of the invention are normally coated on a support together with various hydrophilic or hydrophobic binders. By way of hydrophilic binders one can use, e.g., gelatin, polyvinyl alcohol, hydroxyethyl cellulose or carboxyethyl cellulose alone or in combination and by way of hydrophobic binders one can use, e.g., polyvinyl butyral, triacetyl cellulose or alkyl (meth)acrylate, alkoxyalkyl (meth)acrylate, glycidyl (meth)acrylate, (meth)acrylamide, vinyl esters (e.g., vinyl acetate), acrylonitrile, olefins or styrene alone or in combination, or one can use polymers which have as their monomer components a combination of the above substances with, e.g., acrylic acid, methacrylic acid, $\alpha,\beta$-unsaturated dicarboxylic acid, hydroxyalkyl (meth)acrylate, sulfoalkyl (meth)acrylate or styrenesulfonic acid.

A variety of additives can be employed in the recording material in which the thermodecoloring dyes of the invention are used. Examples include hardeners, brightening agents, dyestuffs, heat solvents, coating assistants, antistatic agents, plasticizers, slip agents, matt agents, stabilizers, ultraviolet ray absorbers, fading preventives and surfactants.

Specifically, additives that can be used include those described in *Research Disclosure,* No. 176, pages 22 to 31 (RD-17643) (Dec. 1978).

Specific examples of the invention, and the effects of the invention, are described in further detail below.

EXAMPLE 1

Measurement of decoloration rate in solution system

Dimethylformamide solutions of thermodecoloring dyes of the invention ($2\times10^{-3}$ mol/l) were immersed in constant temperature baths at 100° C. and their absorbance was measured at set intervals of time. It was found that the decoloration reactions were first order reactions and displayed good linear relations. The rate constant of reaction (k) is tabulated below.

| Thermodecoloring dyes of the invention | k (hr$^{-1}$) |
|---|---|
| (1) | $8.5\times10^{-1}$ |
| (6) | 2.05 |
| (19) | $2.8\times10^{-2}$ |

EXAMPLE 2

Use in heat sensitive recording material 2.0 g of thermodecoloring dye (6) of the invention was dissolved in 30 ml of methyl cellosolve and gradually added to 100 ml of 5% gelatin with stirring. Violet-blue heat sensitive material was produced by coating this solution onto a polyethylene terephthalate support to an amount to provide a wet film thickness of 60 μm, and then drying it.

When this heat sensitive material was heated for 15 seconds by setting a thermal stamp preheated to 200° C. on it, the heated portions lost their color and a colored slide with a good S/N (signal/noise) ratio was produced. Measurement of the optical density of the heated portions and the unheated portions gave the following results.

| Density | |
|---|---|
| Heated portions | Unheated portions |
| 0.05 | 1.45 |

EXAMPLE 3

A black-and-white photomask was overlaid on the heat sensitive material of Example 2 and the material was heated for 30 seconds by means of an 800 W far infrared heater. When the photomask was peeled off, decoloration in correspondence to a black-and-white image took place and a colored slide with a good S/N ratio was obtained. Optical density measurements gave the following values.

| Density | |
|---|---|
| Heated portions | Unheated portions |
| 0.06 | 1.42 |

While the invention has been described in detail and with reference to specific embodiments thereof, it will be apparent to one skilled in the art that various changes and modifications can be made therein without departing from the spirit and scope thereof.

What is claimed is:

1. A recording material comprising a support and at least one thermodecoloring type dye represented by formula (I) or formula (II)

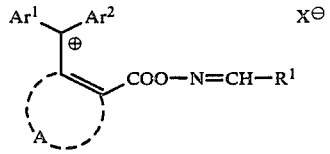

(I)

-continued

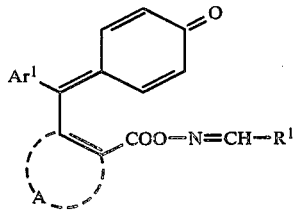

(II)

wherein $Ar^1$ and $Ar^2$ each represents an aryl group or heteroaryl group; $R^1$ represents an alkyl group, alkenyl group, aralkyl group, aryl group, or heteroaryl group; A represents an atomic group forming a 5 or 6 member ring; and $X^{\ominus}$ represents a residue with an electric charge value of $-1$; or $Ar^1$ and $Ar^2$ bond together to form a ring.

2. A recording material as in claim 1, wherein $Ar^1$ and $Ar^2$ each represents an aryl or heteroaryl group substituted with an electron donor group in the ortho or para position.

3. A recording material as in claim 1, wherein $Ar^1$ and $Ar^2$ each represents an group selected from p-dialkylaminophenyl, o-alkoxy-p-dialkylaminophenyl, and 1,2-dialkyl-3-indolyl groups.

4. A recording material as in claim 1, wherein $Ar^1$ and $Ar^2$ combine to form a xanthene group.

5. A recording material as in claim 1, wherein $R^1$ represents an aryl or heteroaryl group.

6. A recording material as in claim 1, wherein $R^1$ represents a member selected from p-dialkylaminophenyl, o-alkoxy-p-dialkylaminophenyl, 2,4,6-trialkoxyphenyl, 2,4,6-trialkylphenyl, 1-naphthyl, 2-alkoxy-1-naphthyl, 2,4-dialkoxy-1-naphthyl, and 1,2-dialkyl-3-indolyl groups.

7. A recording material as in claim 1, wherein A represents a benzene or pyridine ring.

8. A recording material as in claim 1, wherein $X^{\ominus}$ represents a monovalent anionic group selected from $Cl^-$, $Br^-$, $I^-$, $BF_4^-$, $ZnCl_3^-$, $ClO_4^-$, $PF_6^-$, $HSO_4^-$, $TsO^-$ and $CF_3SO_3^-$.

9. A recording material as in claim 1, wherein $Ar^1$ and $Ar^2$ each represents an aryl or heteroaryl group substituted with an electron donor group in the ortho or para position;

$R^1$ represents an aryl or heteroaryl group;

A is a benzene or pyridine ring; and $X^{\ominus}$ represents a monovalent anionic group selected from $Cl^-$, $Br^-$, $I^-$, $BF_4^-$, $ZnCl_3^-$, $ClO_4^-$, $PF_6^-$, $HSO_4^-$, $TsO^-$ and $CF_3SO_3^-$.

* * * * *